US005090076A

United States Patent [19]

Guldager

[11] Patent Number: 5,090,076

[45] Date of Patent: Feb. 25, 1992

[54] MULTIPLE CELL INFLATION ELEMENT

[76] Inventor: Hans Guldager, Hejrevang 1-3, Allerød, Denmark, 3450

[21] Appl. No.: 606,095

[22] Filed: Oct. 31, 1990

[51] Int. Cl.[5] ..... A47C 27/10

[52] U.S. Cl. ..... 5/453; 5/455; 5/456; 137/522; 137/223

[58] Field of Search ..... 5/453, 455, 449, 456, 5/469; 297/DIG. 3; 137/522, 523, 223

[56] References Cited

U.S. PATENT DOCUMENTS

| | | | |
|---|---|---|---|
| 3,822,425 | 7/1974 | Scales | 5/456 |
| 4,448,228 | 5/1984 | Hashimoto et al. | 5/456 |
| 4,646,373 | 3/1987 | Guldager | 5/455 |
| 4,915,124 | 4/1990 | Sember, III | 137/223 |

*Primary Examiner*—Alexander Grosz
*Attorney, Agent, or Firm*—Fleit, Jacobson, Cohn, Price, Holman & Stern

[57] ABSTRACT

A multiple cell inflation structure such as an air cushion or mattress has an arrangement for selectively providing communication between the respective cells when the structure is inflated. Each cell has an air inlet-outlet passage connected with an outside valve chamber and an inflation duct is connected to each valve chamber through respective branch ducts. Each valve chamber includes a valve seat and movable valve element. When the structure is being inflated, the air pressure lifts the valves from their seats so as to connect each cell with the inflation duct. When inflated, air pressure in each cell, along with a spring in the respective valve chamber returns the respective valves to their seats and closes off the cells from one another. Each valve chamber also has a distensible membrane for engaging a stem portion of the respective valve element and moving it off the seat so as to provide communication between the respective cells when the membrane is distended. An air duct leads into each valve chamber to provide air under pressure for distending the membrane. The air ducts are connected to a common air pressure source.

5 Claims, 1 Drawing Sheet

MULTIPLE CELL INFLATION ELEMENT

BACKGROUND OF THE INVENTION

This invention relates to a multiple cell inflation element, such as an air mattress, air cushion or the like.

In multiple cell air mattresses and the like, it is advantageous to have a facility whereby the individual cell can be provided with different inflation pressures. For example, it is advantageous for the cells which receive the maximum load to be able to reduce pressure relative to the cells which are not so heavily loaded.

Earlier U.S. Pat. No. 4,646,373 discloses a multiple cell inflation element in which communication can be selectively provided between the respective cells when the element is inflated so that those cells which are under the maximum load can transfer air to the cells which are not as heavily loaded. In this arrangement, each cell communicates with a common inflation duct through an inflation passage. A valve element located in the cell extends into the inflation passage and all of the valve elements are connected to a common valve actuator. The valve actuator itself takes the form of an inflatable tube positioned within the inflation duct. When the tube is deflated, the various valve elements serve to close the inflation passages of the individual cells and prevent communication between the cells. When the tube is inflated, however, the valve elements are shifted to open the respective passages and allow communication between the cells for the purpose of distributing uneven loads as described above.

SUMMARY OF THE INVENTION

The present invention provides a multiple cell inflation structure of the kind described which has an alternative means for selectively providing communication between the cells when the structure is inflated to compensate for unevenly applied loads.

In the multiple cell structure according to the present invention, each cell communicates with a common inflation duct through a valve chamber located outside of the cell. The valve chamber includes a moveable valve element urged into engagement with a valve seat thereby closing off the cell from the common inflation duct. The inflation duct has branches leading to the respective valve chambers, the arrangement being such that when pressurized air is introduced to the inflation duct, the respective valve elements are moved off the valve seats to allow the air to enter the respective cells. When the air flow is terminated, the air pressure in the respective cells and the urging force on the valves return these to their seats and close off the cells from the inflation duct.

To provide selective communication between the cells, however, when the structure is inflated, each valve chamber also includes an expandable membrane for engaging the stem of the respective valve element. The membranes communicate with air passages connected to a further pressure source. Thus, when pressure is applied from the further pressure source, the respective membranes are expanded to lift the valves off their seats and provide communication between the respective cells through the respective valve chambers and the inflation duct.

Additional features and advantages of the invention will be apparent from the ensuing description and claims read in conjunction with the attached drawings.

DESCRIPTION OF PREFERRED EMBODIMENT

Figure 1:
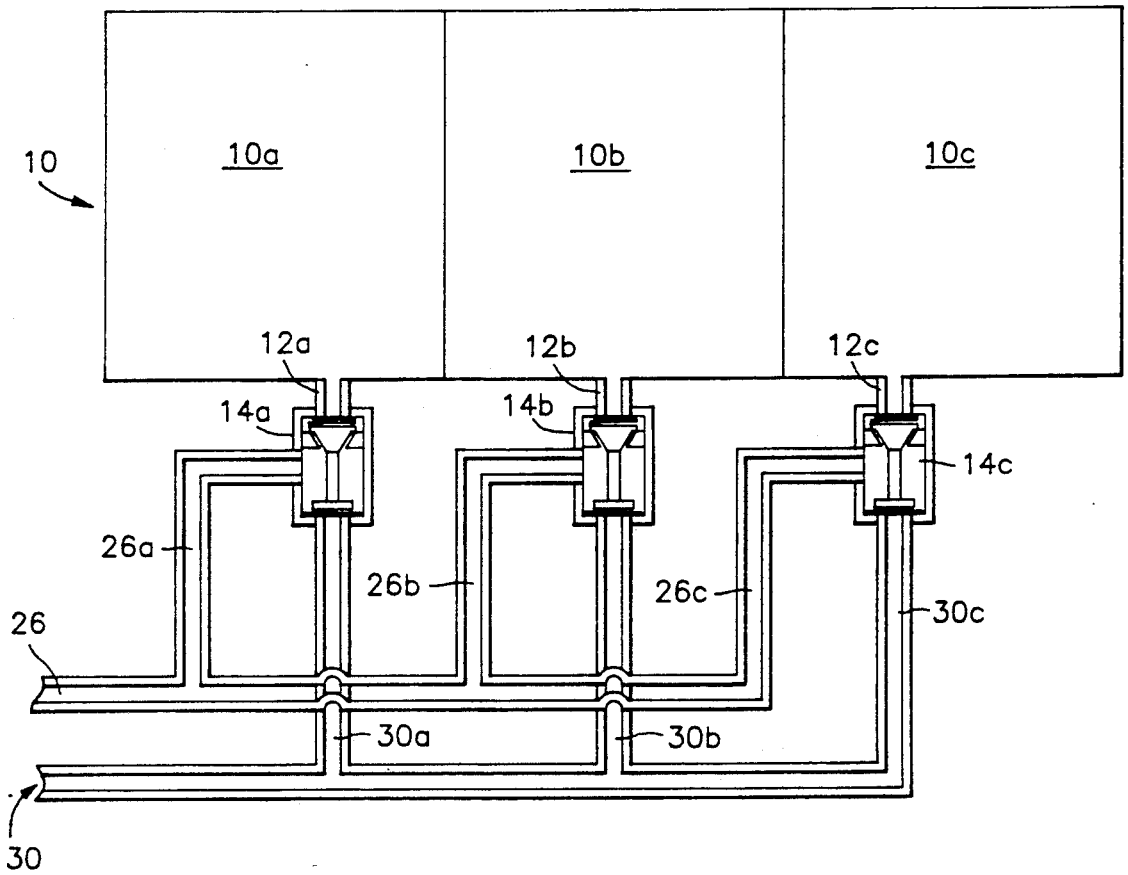
FIG. 1 is a diagrammatic view of a multiple cell inflation element according to the invention.
Figure 2:
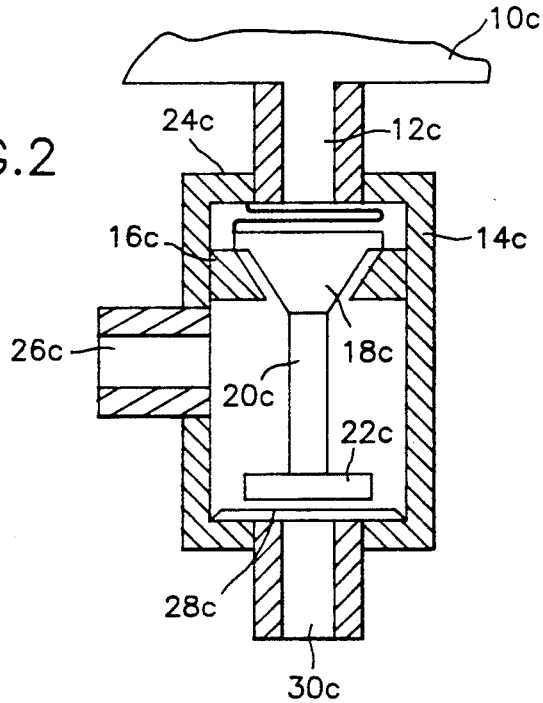
FIG. 2 is an enlarged sectional view of a valve chamber.

FIG. 1 shows a multiple cell inflation element 10 having individual cells 10*a*, 10*b* and 10*c*. The element 10 maybe, for example, comprise an air mattress or air cushion made of suitable flexible material in known manner and the number of cells shown in the drawings is only exemplary. The cells have respective inlet-outlet air passages, 12*a*, 12*b* and 12*c* leading into respective valve chambers 14*a*, 14*b* and 44*c*. The valve chambers are all substantially identical and only chamber 14*c* will be described in detail with reference FIG. 2.

The valve chamber defines an internal valve seat 16*c* for a frusto-conically shaped valve element 18*c* within the chamber. The valve element has a stem 20*c* with an enlarged end 22*c* at the base of the valve chamber. As shown, the air inlet-outlet 12*c* communicates with the top of the valve chamber. A spring 24*c* urges the valve element 18*c* into sealing engagement on the seat. A branch duct 26*c* leading from a common inflation duct 26 leads into the valve chamber under the seat 16*c*. It will apparent from FIG. 1, that the valve chambers 14*a* and 14*b* have equivalent branch ducts 26*a* and 26*b* also leading from the common inflation duct 26.

The base of the valve chamber 14*c* is provided with a flexible diaphragm or membrane 28*c* over which the end 22*c* of the valve element sits, and a pressure applying passage 30*c* leads into the bottom of the valve chamber for extending the membrane as will be described. It will be evident from FIG. 1 that equivalent pressure applying passages 30*a* and 30*b* are provided for the valve chambers 14*a* and 14*b*, the pressure applying passages leading from a common pressure duct 30. Operation of the structure will now be described.

When the element 10 is uninflated, the respective valve elements 18 are in engagement on the respective seats 16. When air under pressure is introduced through the inflation duct 26 and the branches 26*a*–26*c*, the respective valve elements 18*a*–18*c* are lifted from the respective seats to allow the inflation air to inflate the cells 10*a*–10*c* to the required degree. When the structure has been adequately inflated, and the supply of inflation air is terminated, the pressure within the individual cells along with the force of springs 24*a*–24*c* will cause the valve elements to reengage the respective seats thereby sealing the cells one from another and retaining structure 10 in the inflated state.

If it is desirable for communication to be established between the respective cells, for example, to accommodate an unevenly applied load as discussed above, air pressure is applied to passage 30, and thereby to the branches 30*a*–30*c*. The effect is to deform the respective membranes 28*a*–28*c* upwardly, thereby lifting the respective valve elements off their seats and providing intercommunication between the respective cells through the valve chambers, the branch ducts 26*a*–26*c* and the main inflation duct 26. When pressure is removed from passage 30, the membranes 28*a*–28*c* are relaxed, the valve elements return to the valve seats and the respective cells are again mutually isolated. It will be evident, that each valve chamber may have means, such as a spider or the like to prevent the valve element from closing passage 12 when the valve opens.

While only a preferred embodiment of the invention has been described herein in detail, the invention is not limited thereby and changes may be made within the scope of the attached claims.

I claim:

1. A multiple cell inflation structure comprising plural inflatable cells with flexible walls, a separate air inlet-outlet passage leading into each cell, a separate valve chamber connected with each of said passages outside the respective cell, each valve chamber including therein a valve seat and a movable valve element for sealing engagement with and disengagement from said seat, an inflation duct having branch ducts leading into the respective valve chambers for inflating the respective cells with air under pressure received from said inflation duct and by movement of the respective valve elements off the respective seats thereby providing communication between the respective branch ducts and air passages, the configuration of each valve element and seat being such that air pressure in the respective cell when inflated urges the valve element into engagement with the seat, and further including air pressure means for disengaging the respective elements from the respective seats when the structure is inflated so as to provide communication between the respective cells through the respective air passages, valve chambers and branch ducts wherein the air pressure means comprises respective air ducts leading into the respective valve chambers, the respective air ducts being connected to a common source of air pressure.

2. A multiple cell inflation structure as defined in claim 1 wherein the air pressure means further comprises a distensible membrane in each valve chamber configured for engaging a stem portion of the respective valve element and moving the valve element off the respective seat when the membrane is distended, and the air ducts being located for distending the respective membranes.

3. A multiple cell inflation structure as defined in claim 1 wherein each valve chamber further includes a spring means urging the respective valve element into engagement on the respective seat.

4. A multiple cell inflation structure as defined in claim 1 in the form of an air cushion.

5. A multiple cell inflation structure as defined in claim 1 the form of an air mattress.

* * * * *